United States Patent [19]

Fahey

[11] Patent Number: 4,556,338

[45] Date of Patent: Dec. 3, 1985

[54] METHOD FOR REINFORCING PAVEMENT

[75] Inventor: Dennis M. Fahey, Lexington, N.C.

[73] Assignee: Tar Heel Technologies, Inc., Lexington, N.C.

[21] Appl. No.: 512,186

[22] Filed: Jul. 11, 1983

[51] Int. Cl.[4] ..... E01C 5/18; B32B 25/02

[52] U.S. Cl. ..... 404/28; 404/31; 404/70; 404/82; 264/35; 428/295

[58] Field of Search ..... 404/28, 17, 100, 27, 404/82, 70, 31, 32, 45, 72; 264/35, 31; 52/309.17, DIG. 7; 427/136; 428/295, 110, 109

[56] References Cited

U.S. PATENT DOCUMENTS

| | | | |
|---|---|---|---|
| 1,444,274 | 2/1923 | Ridgdon | 404/45 |
| 2,798,822 | 7/1957 | Carter | 404/82 |
| 2,921,463 | 1/1960 | Goldfein | 52/309.17 |
| 3,156,169 | 11/1964 | Finsterwalder | 404/70 |
| 3,603,221 | 9/1971 | Barton | 404/31 |
| 3,657,977 | 4/1972 | Hudis | 404/100 |
| 4,069,182 | 1/1978 | McDonald | 404/72 |
| 4,151,025 | 4/1979 | Jacobs | 404/72 |
| 4,339,289 | 7/1982 | Lankard | 404/28 |
| 4,362,780 | 12/1982 | Marzocchi et al. | 404/17 |
| 4,392,335 | 7/1983 | Heiman | 427/136 |

OTHER PUBLICATIONS

"Rebuilding the Market for Highway Repair" *Chemical Week*, Dec. 1, 1982, pp. 54–55.

Owens/Corning Fiberglas Product Specification, Two pages—Roadglas.

Royston Product Data entitled, "Royston Reflective Cracking Membrane No. 108" (two pages).

PavePrep High-Density Petrochemical Material Brochure, (one page).

Bituthene Waterproofing Systems Techletter, (one page).

FHWA-PA-RD-79-6 Technical Report (3 pages).

FHWA-PA 84-001 Technical Report (six pages).

*Primary Examiner*—James A. Leppink

*Assistant Examiner*—Hoang C. Dang

*Attorney, Agent, or Firm*—Webb, Burden, Robinson & Webb

[57] ABSTRACT

A method for reinforcing pavement involves the orientation of a sheet of elastomeric material reinforced by a plurality of substantially parallel, high tensile strength tire cords embedded therein and bonded thereto on a roadbed so that the tire cord fibers extend in the direction of the stress on the roadbed. The elastomeric material and the tire cord fibers are bonded to the existing roadbed and the roadbed is paved.

18 Claims, 3 Drawing Figures

METHOD FOR REINFORCING PAVEMENT

BACKGROUND OF THE INVENTION

The invention relates to a method for repair and reinforcing pavement, and more particularly, to such methods utilizing a reinforced elastomer.

Roadways are subject to severe stresses mostly due to a heavy volume of traffic and adverse weather conditions. Often such stresses cause the materials in the roadway to fail resulting in the formation of cracks and potholes in the pavement. Such damage is expensive and time-consuming to repair.

In the repair of such damage it has been the practice to fill potholes and the like with asphalt. This filling does remedy the irregularity in the road surface for a short period of time but is ineffective in providing long term repair. A desirable property of any pavement system is that it is unitary and when shifting in the roadbed occurs, the entire pavement moves rather than portions thereof which cause reflective cracking.

Workers in the art have endeavored to repair potholes by filling the potholes with reinforced materials. However, the objective has been to provide a reinforced fill rather than a repair which returns the pavement to its integral form.

One method for strengthening the roadbed during repair is to reinforce the pavement with either woven or nonwoven textile products embedded in an elastomer. Such textile products may be formed of glass fibers as in Marzocchi et al., U.S. Pat. No. 4,362,780 and Jacobs, U.S. Pat. No. 4,151,024, tire stock as in Wescott, U.S. Pat. No. 1,645,635 and Butler, U.S. Pat. No. 1,661,407, fibrous material reclaimed from tire carcasses as in DeWhirst, U.S. Pat. No. 2,126,948, and Butler, U.S. Pat. No. 1,661,407, synthetic or natural fibers as in Jacobs, U.S. Pat. No. 4,151,025 and Draper et al., U.S. Pat. No. 3,474,625, or metal wire, strips or screens as in Leguillon, U.S. Pat. No. 2,184,146, Mart, U.S. Pat. No. 1,505,272 and Rigdon, U.S. Pat. No. 1,444,274. However, the textiles used in such products are used to reinforce the elastomer and not to connect adjacent portions of damaged pavement to return the pavement to its original integral form.

In accordance with the present invention, a reinforcing membrane for road paving repair is provided with high tensile strength which is effectively transferred to the road surface to resist reflective cracking.

Further, in accordance with the invention, an improved pothole repair method is provided.

Still further in accordance with the present invention, a paved surface is provided which gives improved expected life to paved roads due to its ability to resist potholes and cracking from stresses of the roadbed.

Still further in accordance with the invention, a waterproof membrane is provided which seals pavement cracks to retard failure of the paving.

SUMMARY OF THE INVENTION

The present invention provides a method for repairing and reinforcing paved road surfaces that utilizes at least one sheet of elastomeric material reinforced by a plurality of substantially parallel high tensile strength cords embedded therein and bonded thereto. The reinforced sheet is placed over cracks and filled holes in the road surface with the cords oriented in the direction of the stresses and movements of the roadbed related to existing cracks and other paving failures and is then bonded to the road surface. The road surface so repaired and reinforced, when repaved, is highly resistant to recracking and has a greatly extended wear life.

The high tensile strength cords of this invention are selected from a special class of fibrous materials designed for and constructed into high performance cords for the purpose of making the reinforcing plies utilized in the manufacture of tires. Such cords, known in the art as tire cords because of their special development and construction, meet the exacting demands of tire performance.

The term elastomer as used herein includes both synthetic and natural rubber. Natural rubber is the elastic solid obtained from the sap or latex of the Hevea tree, the major constituent being the homopolymer of 2-methyl-1,3-butadiene (isoprene). Synthetic rubber encompasses polymers based upon at least 2 percent of a conjugated unsaturated monomer, the conjugation being in the 1 to 3 position in the monomer chain and the final polymer in its uncured state having an extensibility of at least 200 percent and a memory of at least 90 percent when stretched within the extensibility limits and released instantaneously. The conjugated, unsaturated monomers which are used in the preparation of synthetic rubber are, but are not limited to, chloroprene, butadiene, isoprene, cyclopentadiene, dicyclopentadiene and the like. Other olefins capable of free radical, anionic, or cationic interpolymerization into the polymer chain with the conjugated unsaturated monomer are useful in forming synthetic rubbers. These olefins are typically monoethylenically unsaturated monomers. Monoethylenically unsaturated as used herein is characterized by the monomer having one $CH{=}C>$ group. These monoethylenically unsaturated monomers are, but not limited to, the acrylic monomers such as methacrylic acid, acrylic acid, acrylonitrile, methacrylonitrile, methylacrylate, methylmethacrylate, ethylacrylate, ethylmethylacrylate and the like; monoolefinic hydrocarbons such as ethylene, butylene, propylene, styrene, alpha-methylstyrene and the like; and other functional monounsaturated monomers such as vinylpyridine, vinylpyrollidone and the like functional vinylic monomers. In addition, elastomers based on polyurethanes and the like may also be used in the practice of the invention.

The term tire cord as used herein means and refers to fibrous filaments which are gathered to form a strand and the strand is coated with typically an elastomer and a thermosetting resin. The coated strands are twisted into cord and cured. In tire cords preferably individual filaments are coated with the cured elastomer thermosetting resin composition wherein the individual filaments are isolated from each other.

Fibers, particularly glass fibers, are useful in forming the tire cord of the invention. Examples of tire cords formed from glass fibers are described more fully in Fahey, U.S. Pat. Nos. 3,925,286 and 3,973,071 incorporated herein by reference. Additionally, any high strength fiber material known in the art such as steel, aramid, polyester, nylon and rayon may be used. The cords are preferably formed of glass fiber or polyester. Steel cords require special cutting equipment and must be sealed from moisture at the cut ends to prevent rusting. Generally, the cords are formed of between 5 and 8000 fibers, have a diameter of between 0.5 and 2.5 mm. and have a tensile strength of between 90 and 300 lbs.

The adhesive materials suitable for use in the present invention are any adhesives having good adhesion to the roadbed or pavement to which the elastomeric material is bonded so that the stresses on the roadway are transferred from the roadway to the reinforced elastomeric sheet. A typical adhesive is a rubber cement. The adhesive is preferably thermosetting such as a vulcanizing rubber cement or epoxy so that the adhesive will not soften on a hot day and enable the reinforced elastomeric sheet to slip relative to the crack.

The tire cords are embedded in and bonded to the elastomeric material by calendering or other standard procedures to form the reinforced elastomeric sheet. The cords may be creel calendered as individual ends directly into the elastomeric material or they may be loosely woven with any suitable filling yarn to make a primarily unidirectional fabric prior to calendering. Generally, the tire cords are embedded in the elastomeric material so that there are between 5 and 40 tire cords per inch width of the elastomeric sheet. Thus, the reinforced elastomeric sheet has a tensile strength of between 1000 and 3000 lbs per inch width of the sheet in the direction of the tire cord. The elastomeric sheet is preferably between 0.05 and 0.35 inches thick. If desired, an elastomeric sheet approximately 0.625 inches thick may be used without the need for additional paving material.

In order to install the reinforced elastomeric sheet on an existing pavement, the existing pavement is dried, cleaned of debris, leveled and coated with the adhesive. The elastomeric sheet is placed thereon so that the tire cords extend in the direction of the stress that is causing the failure of the roadway. Thus, the elastomeric material and the tire cords are bonded to the pavement. The pavement is then paved with any suitable paving material.

Alternatively, the elastomeric sheet may include, on at least one surface, an adhesive material which will cure and cause the elastomeric sheet to bond to the pavement due to the heat generated upon the application of a molten paving material to the pavement.

In cases where road crack stresses are to be controlled in more than one direction a layered system of a laminated sheet or a plurality of single sheets having a layer of adhesive applied between them may be used with the tire cords in adjacent sheets extending at an angle generally between 45° and 90° to each other.

Thus, the present invention provides a superior reinforcement for a pavement due to the high tensile strength of the tire cords which are bonded directly to the pavement. In addition, the elastomeric used in the reinforcement enables the reinforcement to tolerate extended wear.

DETAILED DESCRIPTION OF THE PREFERRED EMBODIMENTS

Figure 1:
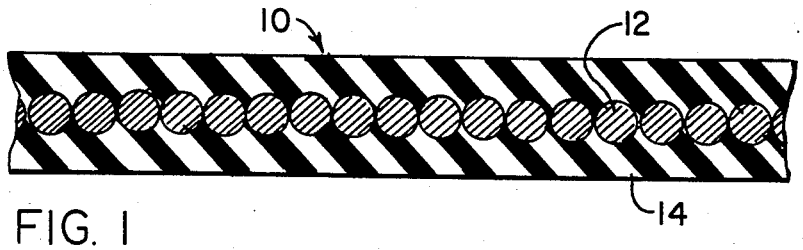
FIG. 1 is a cross-sectional view through the reinforcing sheet used in the method of the present invention.
Figure 2:
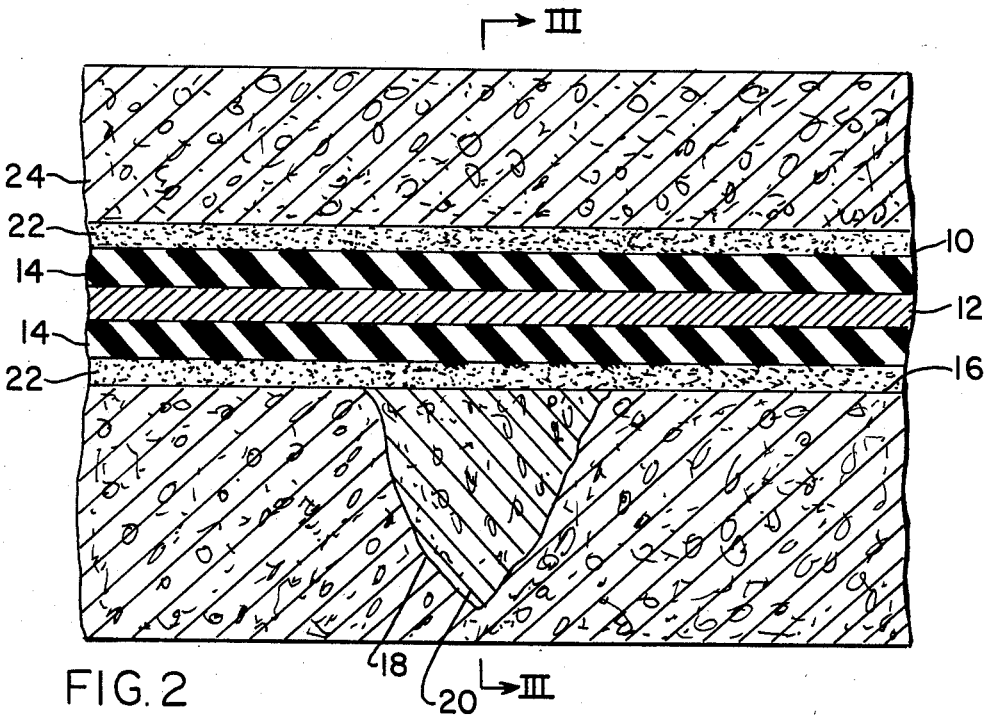
FIG. 2 is a cross-sectional view of a pavement repaired by the method of the present invention.
Figure 3:
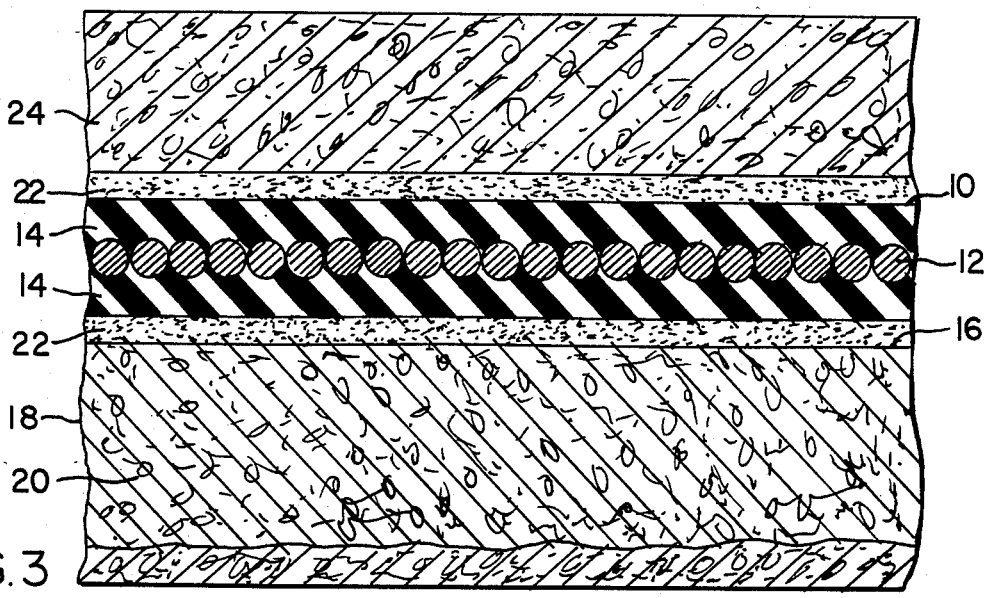
FIG. 3 is a cross-sectional view of a pavement repaired by the method of the present invention taken along line III—III of FIG. 2.

With reference to the figures, an elastomeric sheet 10 including a plurality of parallel tire cords 12 embedded in an elastomer 14 is used to repair pavement.

The surface of the pavement 16 is prepared by cleaning it of debris, drying it and filling all holes and cracks 18 with a suitable material such as a compacted aggregrate or bituminous mixture of asphalt tar 20 so that the pavement surface 16 is smooth and level. The road surface 16 is then coated with an adhesive material 22. Elastomeric sheet 10 is placed over the adhesive material 22 so that tire cords 12 extend in the direction of stress and the road surface is paved with a suitable material 24.

EXAMPLE 1

A strip of concrete pavement with cracks therein is first made relatively smooth and level as necessary by filling all holes or large cracks (over one inch) with either a compacted aggregrate-bituminous mixture or asphalt tar. The clean, dry road surface is then sprayed with rubber cement and a layer of a sheet of uncured rubber with tire cord embedded therein is immediately placed over each crack so that the embedded cords lie perpendicular across the crack. The edges and joints are sealed with additional rubber cement if needed. The road surface is then paved with a layer of ⅝" thick of hot bituminous concrete paving. The paving serves to cure the rubber and complete a secure bonding and thus provides a long wear, crack-free roadway. The elastomeric sheet is reinforced with 14 cords per inch K-5 1/0 glass fiber tire cord providing 2800 lbs tensile per inch width of sheeting.

EXAMPLE 2

A strip of concrete pavement is repaired as in Example 1 using an elastomeric sheet reinforced with 10 cords per inch of K-5 1/0 glass fiber tire cord which provide 2000 lbs tensile per inch width of sheeting.

EXAMPLE 3

A strip of concrete pavement is repaired as in EXAMPLE 1, using an elastomeric sheet reinforced with 14 cords of 1300/2/3 (7800 total denier) polyester tire cord per inch which provide 1820 lbs tensile per inch width of sheeting.

EXAMPLE 4

A strip of concrete pavement is repaired as in Example 1, using an elastomeric sheet reinforced with 8 cords of 1X10X0.01 inch steel wire cord per inch which provide 2000 lbs tensile per inch width of sheeting.

EXAMPLE 5

A strip of asphalt paved roadway shows considerable wear with extensive cracking and potholes of moderate size. The road surface is again made relatively level and smooth as in EXAMPLE 1 by filling the large holes and cracks. The pothole is dried with a torch, cleaned of debris and moisture sealed with a spray of rubber cement or rubberized asphalt prior to the filling. The reinforcing sheet has an adhesive uncured rubberized asphalt on the bottom side and no pretreatment or additional adhesive agent is needed. The cord is K-5 1/0 glass at 14 ends per inch spacing but, due to the presence of transverse as well as longitudinal reflective cracking, the cord is in two plies lying at a 60° angle relative to each other. When the ⅝" thick layer of hot bituminous concrete paving is applied the reinforcing sheets flow, cure and are firmly bonded to the roadway.

EXAMPLE 6

A typical pothole in an otherwise reasonably good condition asphalt paved roadway is repaired as follows. First the area about the hole is dried with a torch and sealed with rubber cement or rubberized asphalt. Then the hole is filled level with the road surface with a typical compacted aggregate-bituminous patching mixture. The surface is next treated thoroughly with a good contact rubber cement mixture either by brush or by spraying. The tire cord reinforced sheeting is a very hard high wear resistant rubberized asphalt and is laid down as two separate sheets, the first with a polyester cord oriented perpendicularly to the direction of traffic and extending 6 to 10 inches beyond the edges of the hole. Again the surface area is treated with the contact rubber cement and the second layer of the same type sheeting this time with the cords parallel to the direction of traffic and overlapping 6 to 10 inches beyond the edges of the rectangular hole. The whole area may then be covered with a $\frac{5}{8}''$ layer of bituminous concrete.

EXAMPLE 7

A pothole is repaired as in Example 6, however, a single rubber sheet is used having a laminate structure with two plies of cord at 90° to one another instead of two separately installed elastomeric sheets.

EXAMPLE 8

A pothole is repaired as in Example 6, however, the elastomeric sheet is formed of an uncured elastomer which is cured by the heat from the melted rubberized asphalt cement used to pave the roadbed.

Although the invention has been described with reference to particular embodiments, the invention is only to be limited so far as is set forth in the accompanying claims.

I claim:

1. A method for repairing and reinforcing pavement comprising the steps of selecting members of a special class of high performance, high tensile strength cords known as tire cords, said cords comprising filaments gathered and twisted to form a strand having a tensile strength between about 90 and 300 pounds, embedding and bonding a plurality of said cords in a substantially parallel manner into an elastomer to form a unidirectionally reinforced elastomeric membrane, placing at least one such membrane across the cracks or filled holes in a cracked but repairable road surface so that the cords of the reinforcement are in the direction of the stresses responsible for the cracks or holes and bonding with a thermosetting cement said membrane securely in place either prior to or simultaneously with final repaving of the road surface with asphalt.

2. A method according to claim 1 wherein said tire cords are formed of a material from the group consisting of steel, aramid, glass fiber, polyester, nylon and rayon.

3. A method according to claim 1 wherein said bonding means is a thermosetting rubber cement.

4. A method according to claim 1 wherein said elastomeric sheet includes, on at least one surface, an adhesive material which will cure and cause said elastomeric sheet to bond to the roadbed due to the heat generated upon the application of the paving material to the roadbed.

5. A method according to claim 1 wherein said elastomeric sheet is sealed to said pavement to prevent water from reaching the underlying surface of the pavement.

6. A method according to claim 1 wherein a plurality of said sheets of tire cord reinforced elastomer are bonded together, the angle between the tire cords in adjacent sheets being from 45° to 90°.

7. A method according to claim 1 wherein said tire cords are embedded in said elastomeric material so that there are between 5 and 40 tire cords/inch width elastomeric material.

8. A method according to claim 7 wherein said elastomeric sheet has a tensile of between 1000 and 3000 lbs./inch width.

9. A method according to claim 1 wherein said elastomeric sheet has a tensile of between 1000 and 3000 lbs/inch width.

10. A reinforced pavement comprising: an underlying partially failed pavement with cracks or holes which have been filled where necessary; at least one elastomeric sheet reinforced with a plurality of special high performance, high tensile cords known as tire cords embedded therein, said cords comprising filaments gathered and twisted to form a strand having a tensile strength between about 90 and 300 pounds and bonded thereto; said elastomeric sheet adhered with a thermosetting cement to said underlying partially failed pavement to provide reinforcing tensile strength in the direction of the stress on the underlying pavement related to said cracks or holes therein, said elastomeric sheet overlayed with asphalt paving; means associated with said elastomeric sheet for bonding said tire cords and said elastomeric material to said underlying partially failed pavement and means associated with said elastomeric sheet for paving over said roadbed with asphalt.

11. A reinforced pavement composition as recited in claim 10 wherein said tire cords are formed of a material from the group consisting of steel, aramid, glass fiber, polyester, nylon and rayon.

12. A reinforced pavement composition as recited in claim 10 wherein said bonding means is a thermosetting rubber cement.

13. A reinforced pavement composition as recited in claim 10 wherein said elastomeric sheet includes, on at least one surface, an adhesive material which will cure and cause said elastomeric sheet to bond to the underlying pavement due to the heat generated upon the application of the paving material to the underlying pavement.

14. A reinforced pavement composition as recited in claim 10 wherein said elastomeric sheet is sealed to prevent water from reaching the underlying pavement.

15. A reinforced pavement composition as recited in claim 10 wherein a plurality of said sheets of tire cord reinforced elastomer are bonded together, the angle between the tire cords in adjacent sheets being from 45° to 90°.

16. A reinforced pavement composition as recited in claim 10 wherein said tire cords are embedded in said elastomeric material so that there are between 5 and 40 tire cords/inch width elastomeric material.

17. A reinforced pavement composition as recited in claim 16 wherein said elastomeric sheet has a tensile of between 1000 and 3000 lbs./inch width.

18. A reinforced pavement composition as recited in claim 10 wherein said elastomeric sheet has a tensile of between 1000 and 3000 lbs/inch width.

* * * * *